US005927451A

United States Patent [19]

Tsai

[11] Patent Number: 5,927,451

[45] Date of Patent: Jul. 27, 1999

[54] TOP HOOD STRUCTURE FOR TRUNK/ BRIEFCASE WITH A TELESCOPIC LEVER UNIT

[76] Inventor: Cheng-Hsien Tsai, No. 103, Da-Ming I Road, Taien-Tzu Hsiang, Taichung Hsien, Taiwan

[21] Appl. No.: 08/964,200

[22] Filed: Nov. 4, 1997

[51] Int. Cl.[6] ..... A45C 13/00

[52] U.S. Cl. ..... 190/115; 190/124; 190/114; 190/18 A; 16/115

[58] Field of Search ..... 16/115; 190/115, 190/114, 105, 124, 127, 18 A

[56] References Cited

U.S. PATENT DOCUMENTS

| | | | |
|---|---|---|---|
| 4,621,404 | 11/1986 | Browning | 190/115 X |
| 5,131,513 | 7/1992 | Gossage | 190/107 |
| 5,339,934 | 8/1994 | Liang | 190/115 X |
| 5,377,795 | 1/1995 | Berman | 190/18 A |
| 5,566,798 | 10/1996 | Tsai | 190/127 X |
| 5,575,362 | 11/1996 | Franklin et al. | 190/115 |
| 5,593,009 | 1/1997 | King | 190/115 X |
| 5,620,069 | 4/1997 | Hurwitz | 190/107 |
| 5,685,402 | 11/1997 | Lin | 190/115 |
| 5,690,217 | 11/1997 | Friday | 190/115 X |
| 5,762,170 | 6/1998 | Shyr et al. | 190/115 X |
| 5,782,325 | 7/1998 | O'shea et al. | 190/127 X |
| 5,803,214 | 9/1998 | Wang | 190/115 |
| 5,806,638 | 9/1998 | Mao | 190/115 |

*Primary Examiner*—Gary E. Elkins
*Assistant Examiner*—Tri M. Mai
*Attorney, Agent, or Firm*—Bacon & Thomas

[57] ABSTRACT

A trunk or briefcase that may be pulled or pushed to move, the top part of the telescopic lever unit may be accommodated in a top hood, the top hood being made of a soft plastic material, with its surrounding edge sewed onto the outside of the trunk or briefcase, so that when the trunk or briefcase is opened, there will be no hindrance caused by the material of the top hood, and that the hood may be opened to its fullest to facilitate the user in taking out or putting in personal articles.

5 Claims, 5 Drawing Sheets

TOP HOOD STRUCTURE FOR TRUNK/ BRIEFCASE WITH A TELESCOPIC LEVER UNIT

BACKGROUND OF THE INVENTION

The subject invention relates to a top hood structure for a trunk/briefcase with a telescopic lever unit that can be pulled or pushed to move the trunk/briefcase, said top hood is made of a soft plastic material, the protruding top of the telescopic lever unit may be accommodated in the top hood, the surrounding edge of the top hood is sewed onto the outside of the trunk or briefcase, so that due to the property of the flexible top hood, it will be quite convenient to put or take personal articles into or out of the trunk/briefcase.

PRIOR ART

Since the pulling type of trunk became popular, all types and sizes of trunks are manufactured with the equipment of the telescopic lever unit and rollers, so that the trunk may be lifted, pulled or pushed to move ahead, it has become quite convenient for the consumers; such a trend has soon extended to the application of briefcases. More and more people are going abroad for business purposes, and the briefcase has become a necessity. Carrying the briefcase at all times by hand could be a great burden. Therefore, more and more briefcases are equipped with telescopic levers and rollers; however, either in a trunk or a briefcase, it has a pulling lever that involves a top hood to fix the lever and accommodate the handle, as shown in FIG. 1, said briefcase 90 comprises a handle 93 and a telescopic lever 95, at each of two ends on the bottom at one side with the telescopic lever 95 is a roller 96, on the top extension at the longer side of the briefcase 90 is a first plate 92, on the top extension opposite the longer side is a second plate 94, the two plates are bent and overlapped at the opening of the briefcase 90, the second plate 94 on top of the second plate 92, to seal the opening, on the second plate 94 is an opening to expose the handle 93 that is fixed on the first plate 92, besides, on the first plate 92 and the second plate 94 are mutually buckled locks as security device for the briefcase; on the top of the telescopic lever 95 on the briefcase 90 is a top hood 97, said top hood 97 is located at the intersection 99 of the vertical and the horizontal sides, of an arc shape, the top hood 97 contains an accommodating chamber 971 that serves to accommodate the handle 951 on top of the lever 95; when the user wishes to pull said briefcase 90 by the pulling lever 95, he may reach his hand into the accommodating chamber 971 to lift the handle of the telescopic lever unit until it is fully pulled out; but since the top hood 97 is made of a hard material, when it is fixed at the intersection 99 of the two sides of the briefcase 90, there must be a tightening component to fasten it onto the briefcase 90, and since the top hood 97 has a quite high hardness, when it is fastened to the intersection 99 of the two sides of the briefcase 90, and when the second plate 94 is lifted, because of the restriction of the hardness of the top hood 97, the lifted width is from the free end to the first imaginary line 98, so there will be a portion at the opening of the briefcase 90 (from the first imaginary line 98 to the intersection 99 of two sides) will be obstructed by the second plate 94, when the user tries to lift the two plates 92 and 94 to take out or put in articles, the half opened opening will cause quite an inconvenience, though there is quite a large space inside the briefcase 90, but due to the obstruction by the top hood 97, the opening is reduced, and the result is that there would be a large part below the second plate 94 inside the briefcase 90 that could not be put to proper use; in order to take a document out of the briefcase 90, the user has to take out all other objects on top, so it becomes quite inconvenient in taking out and putting in articles, even more inconvenient than the old product without the equipment of the lever since it is not restricted by the top hood, so the two plates 92 and 94 can be fully bent and opened from the intersection of the two sides, so that the briefcase may be opened to its fullest, upon comparison, the consumers would rather choose to purchase a briefcase without the equipment of the lever, than to buy a pulling briefcase.

The same problem occurs also on the application of a cover lifting trunk, therefore, it has always been trying to know how to solve the problem that influences the opening of a briefcase, in order to make the consumers to wholly accept the trunk or briefcase that is equipped a telescopic lever unit.

In order to seek an improvement on such weaknesses in the conventional devices and structures, the subject inventor has devoted intensive and extensive efforts in the research and experiments, and has successfully developed and designed the subject invention.

SUMMARY OF THE INVENTION

The primary objective of the subject invention is to present a type of soft plastic top hood that is sewed onto the briefcase or trunk, so the top hood may bend and cause no hindrance in lifting the hood of a briefcase or a trunk.

DETAILED DESCRIPTION OF PREFERRED EMBODIMENT

The term "trunk" used in the subject description refers to any trunk that may be pulled or pushed to move, comprising a telescopic lever unit and at least one pair of rollers that are attached to the bottom of the trunk, so designed that the trunk may be lifted or moved by pulling or pushing on the pulling lever; while the term "briefcase" used in the subject description refers to a regular briefcase that is generally used for official or commercial purposes to contain documents, books or data papers, etc., comprising a telescopic lever unit and at least one a pair of rollers that are attached to the bottom of the briefcase, so designed that the briefcase may be lifted or carried on shoulders, or moved by pulling or pushing on the pulling lever.

Figure 1:
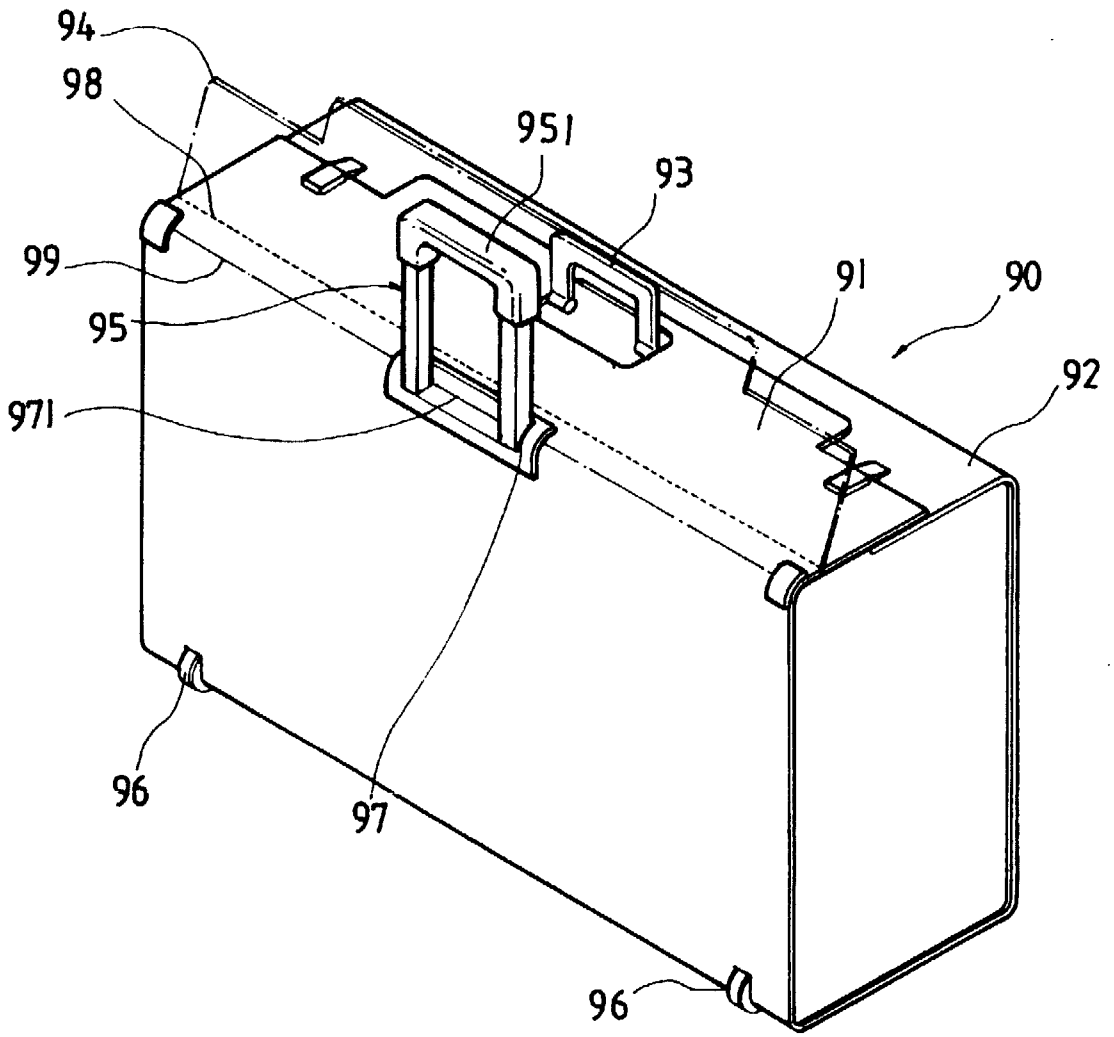
FIG 1 PRIOR ART
FIG. 1 is a perspective view of a prior art of pulling briefcase.
Figure 2:
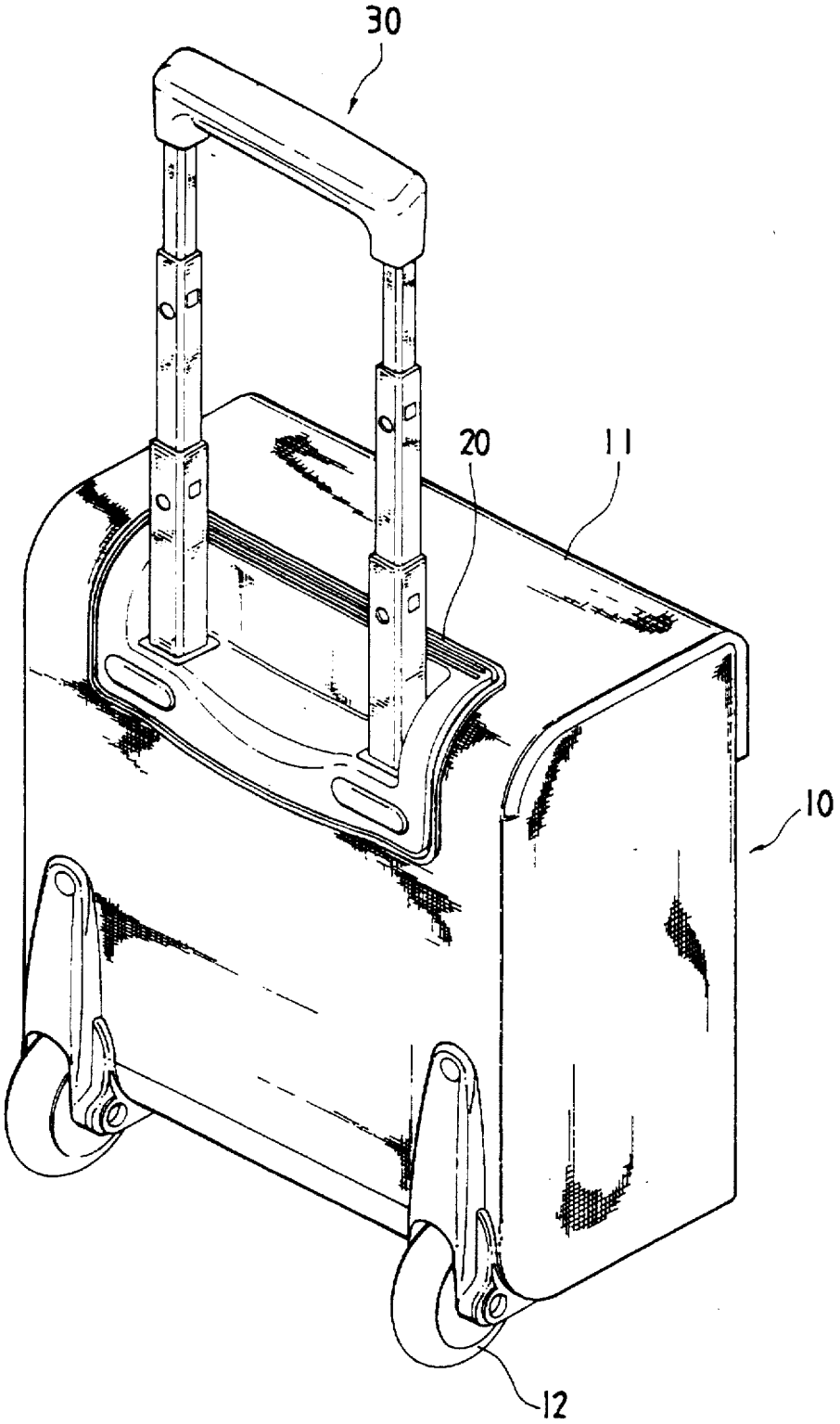
FIG. 2 is a perspective view of the subject invention of top hood applied to a pulling or pushing trunk.
Figure 3:
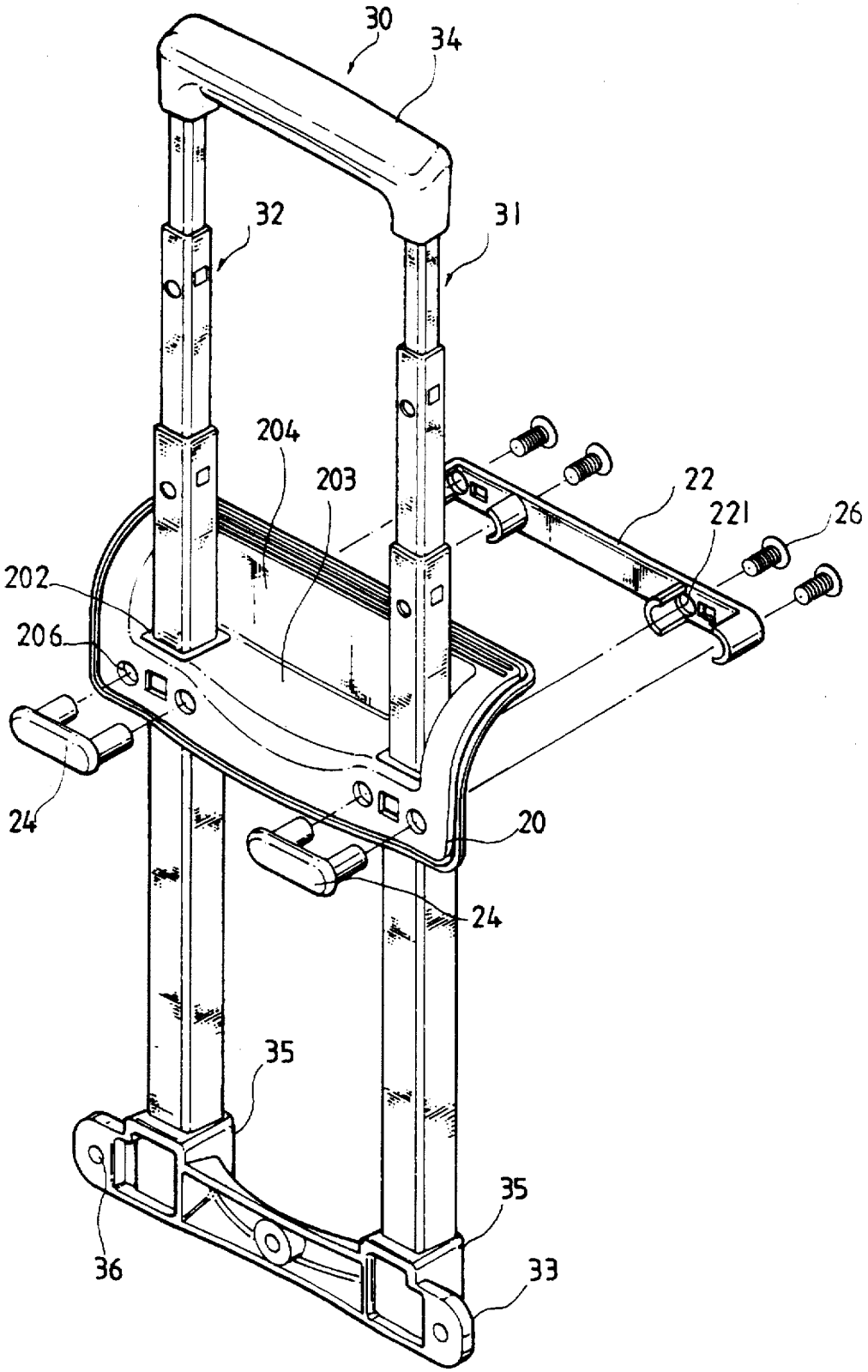
FIG. 3 is an illustration of the top hood and telescopic lever unit without showing the trunk.

Referring to FIGS. 2 and 3, the trunk 10 comprises a retractable telescopic lever unit 30, to the right and left sides on the bottom of the trunk 10 are attached with at least one a pair of rollers 12, the telescopic lever unit 30 comprises a first lever unit 31 and a second lever unit 32, the first lever unit 31 and the second lever unit 32 are of the same construction comprising a number of sleeve tubes of different diameters and accommodated one in the other, since that is a well-known prior art which construction shall need no elaboration here. One ends of the first lever unit 31 and the second lever unit 32 are connected with a handle 34, while the other ends are respectively inserted in two fixing holes 35 in the first fixed crossbar 33, on said first fixed crossbar 33 are a number of first through holes 36 that serve to fasten the first fixed crossbar 33 with a tightening component (not shown in drawing) onto one side in the trunk 10.

On the same side on top of the trunk 10 and on the first fixed crossbar 33 is a top hood 20 which is made of a soft plastic material, and the top side edge along the top hood 20 is sewed onto the outside on top of the trunk 10, so the top hood 20 is exposed on the outside, said top hood 20 is shaped in an arc plate to suit the arc intersection of the vertical side and horizontal side of the top parts of the trunk 10, in the middle of the top hood 20 is the formation of a depressed accommodating chamber 204 with a carrier side 203, in the carrier side 203 are two through holes 202 that are spaced at a distance that equals the distance between the first lever unit 31 and the second lever unit 32, to be inserted by the levers of the first lever unit 31 and the second lever unit 32 of the telescopic unit 30, when the telescopic unit 30 is collapsed, the handle 34 can be accommodate properly inside the depressed accommodating chamber 204; on the side where the vertical back side of the top hood 20 and the trunk 10 are overlapped are two sets of third through holes 206, each set comprising two holes, the two third through holes 206 in each set are located at the left and right sides of the telescopic levers, to clamp the levers between the holes.

The top side edge of top hood 20 is sewed onto the intersection of the vertical sides and horizontal sides on top of the trunk 10, the bottom of the telescopic lever unit 30 is fastened onto the inside bottom of the trunk by the first fixed crossbar 33, the two sets of lever units 31 and 32 are respectively pulled through the two second through holes 202 on the top hood from inside the trunk 10, so the handle 34 may be protruding out of the trunk 10 and accommodated in the depressed accommodating chamber 204; in order to fasten the telescopic lever unit 30 and the top hood 20 tightly together, there is the equipment of the second fixed crossbar 22, and two sets of binocular type twin screw tubes 24, on the second fixed crossbar 22 are four fourth through holes 221 that correspond one by one to the third through holes 206, on the inside walls of the twin screw tubes 24 are screw threads (not shown in drawing), so that the second fixed crossbar 22 may lean on the two sets of lever units 31 and 32 from inside the trunk 10, and then on the outside of the trunk 10, the twin screw tubes 24 will pull through the third through holes 206 to push the second fixed crossbar 22, then, the bolts 26 are respectively inserted through the fourth through holes 221 and tightened with the twin screw tubes 24, hence the top hood 20, the trunk 10 and the telescopic lever unit 30 are fastened together.

The top hood 20 may be made of soft plastic materials such as PVC (Polyvinyl Chloride) or TPR (Thermoplastic Rubber).

Figure 5:
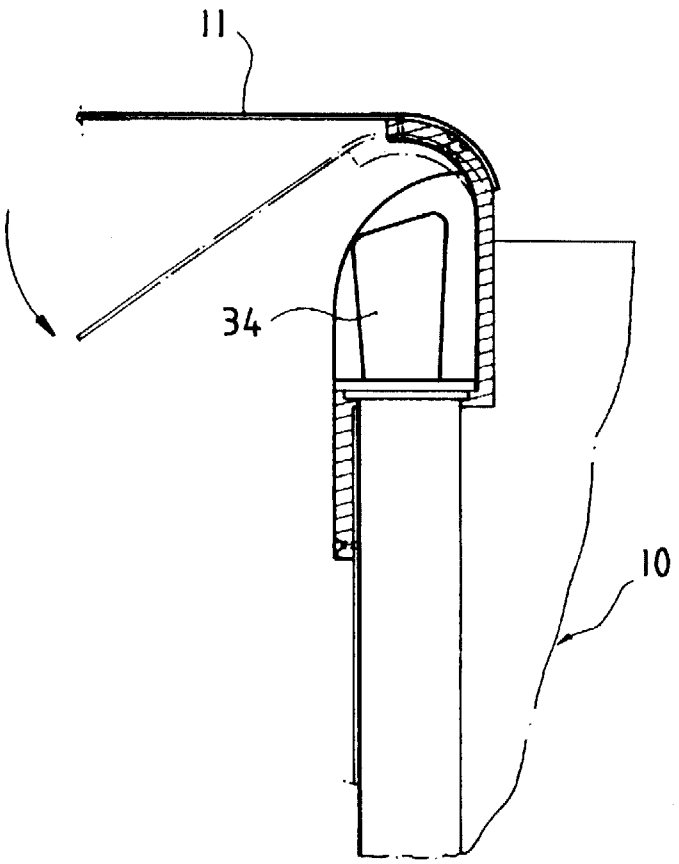
FIG. 5 is a partial section view of the opened part of the pulling briefcase, showing the top hood being bent, without obstructing the opening of the briefcase.
Figure 4:
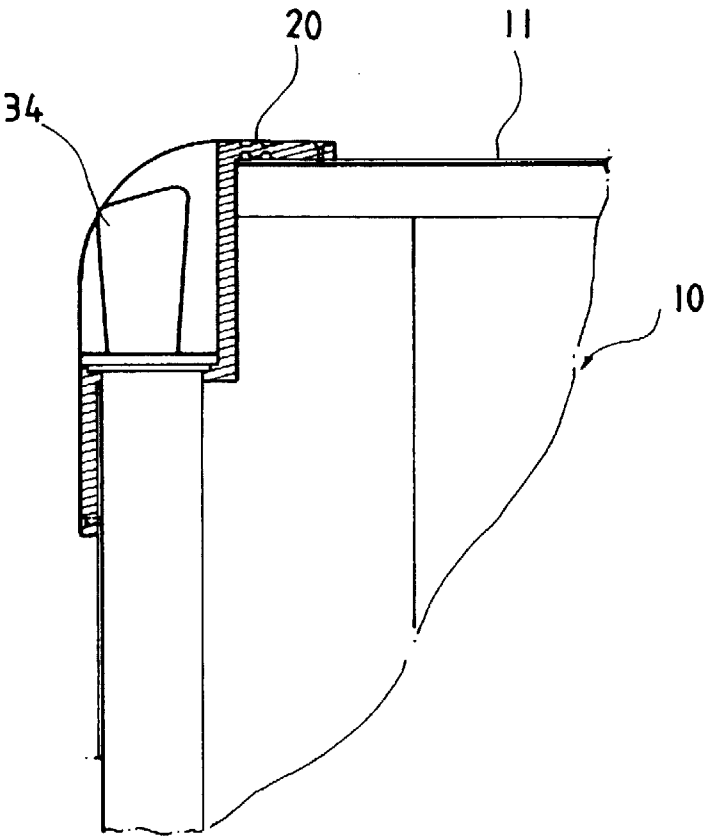
FIG. 4 is a partial section view of the closed part of the pulling briefcase, with the telescopic lever being collapsed, and the top of the lever being accommodated in the accommodating chamber on the top hood.

To use this product, please refer to FIGS. 4 and 5, a portion of the intersection of the vertical sides and the horizontal sides of the top hood 20 on top of the trunk 10 has extended to the cover 11 on the opening of the trunk 10, in case of a prior art of trunk, the top hood is made of a hard material, then, the process in lifting the trunk cover will be influenced, and, the width of the trunk opening will be reduced, but please refer to FIG. 5, since the top hood 20 in the subject invention is made of a soft plastic material, the flexible top hood 20 will bend itself when the trunk cover 11 is opened, so that the width of the opening on top of the trunk 10 may be opened to its fullest, and so the user may take or put personal objects out of or into the trunk 10 without causing any inconvenience.

Figure 6:
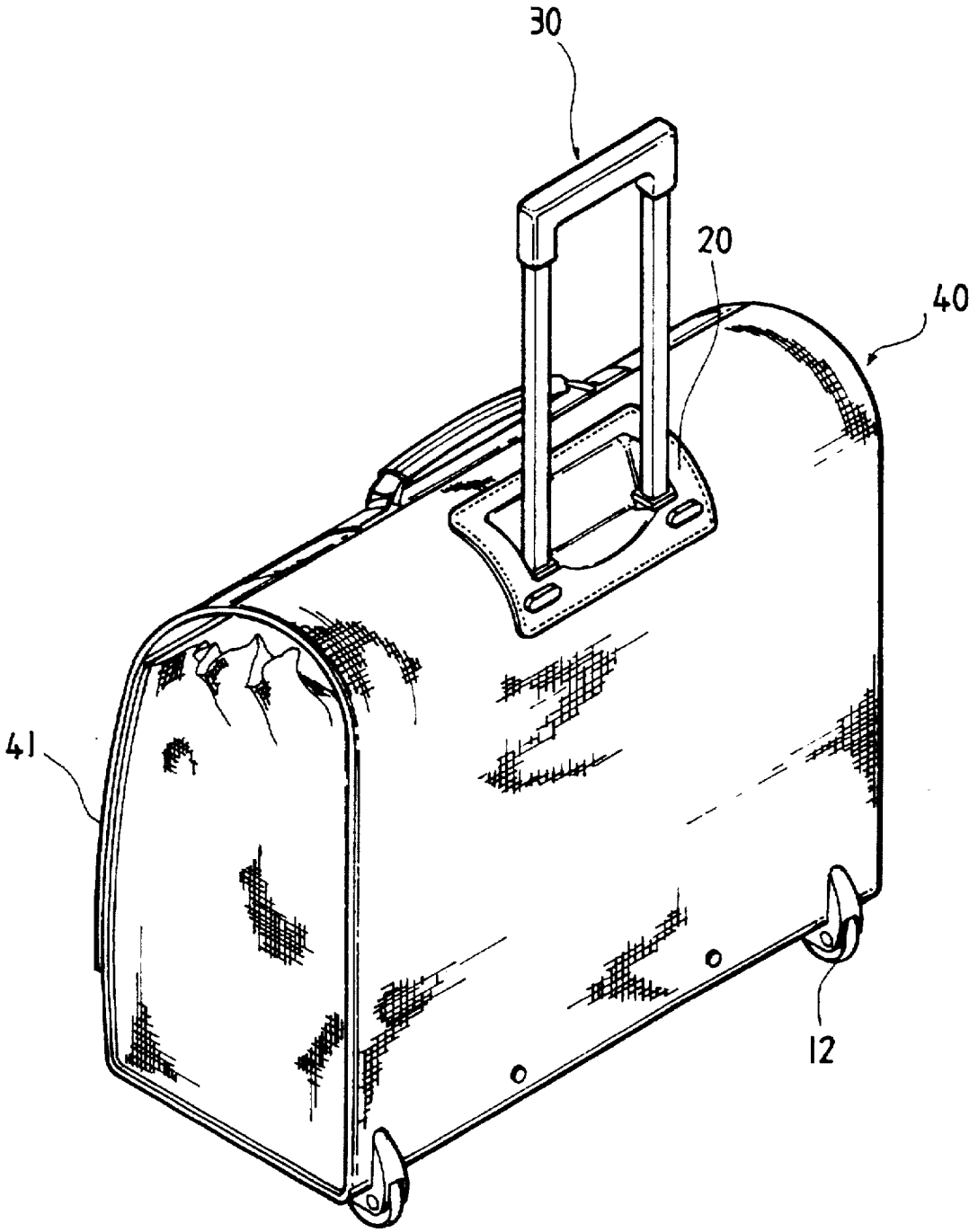
FIG. 6 is an illustration of the subject invention of top hood when applied to a pulling briefcase.

Please refer to FIG. 6 which is another embodiment of the subject invention, wherein the flexible top hood 20 is applied to a briefcase 40, said briefcase 40 comprises a telescopic lever unit 30, a set of rollers 12 and a top hood 20, the telescopic lever unit 30 and the top hood 20 and the briefcase 40 are fixed in the same way as the previously described embodiment; if a conventional top hood is to be used, then, the lifting of the hanging flap 41 on the opening of the briefcase 40 will be restricted by the lack of flexibility of the hard material of the conventional top hood, so it will be impossible to fully open the briefcase 40, but since the subject invention of the top hood 20 is made of a soft plastic material, the hanging flap 41 on the briefcase may be bending without any problem, so that the briefcase 40 may be opened to its fullest to enable best convenience to the user.

The subject description covers only the preferred embodiment of the subject invention. All equivalent structural and/or configurational variations and/or modifications easily conceivable to anyone skilled in the subject art, and deriving from the subject description with drawings herein shall reasonably be included in the intent and scope of the subject claim.

I claim:

1. A top hood and lever assembly for a trunk having a top opening, a top panel for opening and closing the top opening, and a back panel, the assembly comprising:

a) an arc-shaped hood formed of soft plastic material and including a top side having a front edge, a back side, and a chamber disposed between the top and back sides;

b) a telescopic lever unit extending through a bottom wall of the chamber and including a handle, the lever unit being extendable outwardly into a position of use and retractable inwardly into a position of storage wherein the handle is disposed within the chamber; and c) the front edge of the top side of the hood being securable to a back edge of the top panel of the trunk, the back side of the hood being securable to the back panel of the trunk, whereby when the handle is disposed within the chamber and the top panel of the trunk is disposed in an open position, both the back edge of the top panel and the front edge of the top side of the hood are folded rearwardly over the chamber to fully expose the top opening of the trunk and permit access to the interior thereof.

2. The top hood and lever assembly of claim 1 wherein the soft plastic material includes polyvinylchloride.

3. The top hood and lever assembly of claim 1 wherein the soft plastic material includes thermoplastic rubber.

4. The top hood and lever assembly of claim 1 wherein the telescopic lever unit includes:

a) a pair of telescoping levers, each lever having an upper end and a bottom end;

b) the handle is secured to the upper ends of the levers;

c) a first crossbar for attachment to a side of the trunk, the bottom ends of the levers being engaged with the first crossbar; and d) a second crossbar for securing the back side of the hood to the back panel of the trunk.

5. The top hood and lever assembly of claim 4 wherein the second crossbar further includes two pairs of threaded tubes and two pairs of threaded fasteners for securing the back side of the hood to the back panel of the trunk.

* * * * *